US012623264B2

(12) United States Patent
Hioka et al.

(10) Patent No.: US 12,623,264 B2
(45) Date of Patent: May 12, 2026

(54) MANUFACTURING METHOD AND MANUFACTURING EQUIPMENT OF COLD-ROLLED STEEL SHEET

(71) Applicant: JFE Steel Corporation, Tokyo (JP)

(72) Inventors: Daiki Hioka, Tokyo (JP); Yukihiro Matsubara, Tokyo (JP); Noriki Fujita, Tokyo (JP); Masaki Hino, Tokyo (JP); Tetsuya Arakawa, Tokyo (JP); Miwa Ohashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 238 days.

(21) Appl. No.: 18/283,550

(22) PCT Filed: Dec. 15, 2021

(86) PCT No.: PCT/JP2021/046317
§ 371 (c)(1),
(2) Date: Sep. 22, 2023

(87) PCT Pub. No.: WO2022/230229
PCT Pub. Date: Nov. 3, 2022

(65) Prior Publication Data

US 2024/0165683 A1 May 23, 2024

(30) Foreign Application Priority Data

Apr. 30, 2021 (JP) ..... 2021-077586

(51) Int. Cl.
*B21B 1/28* (2006.01)
*B21B 38/00* (2006.01)
*B21B 1/22* (2006.01)

(52) U.S. Cl.
CPC ..... *B21B 1/28* (2013.01); *B21B 38/006* (2013.01); *B21B 2001/221* (2013.01)

(58) Field of Classification Search
CPC ..... B21B 2001/221; B21B 1/28; B21B 37/74; B21B 38/006
See application file for complete search history.

(56) References Cited

U.S. PATENT DOCUMENTS 3,877,867 A * 4/1975 Tsuchiya ..... C21D 9/0081 72/200
4,765,169 A * 8/1988 Bradlee ..... B21D 1/05 72/8.5

(Continued)

FOREIGN PATENT DOCUMENTS

CN 1675008 A 9/2005
CN 101550480 A 10/2009

(Continued)

OTHER PUBLICATIONS

JP 61-15919A, Shitomi et al. Jan. 1986.*

(Continued)

*Primary Examiner* — Edward T Tolan
(74) *Attorney, Agent, or Firm* — Buchanan Ingersoll & Rooney PC

(57) ABSTRACT

A manufacturing method of a cold-rolled steel sheet in which the method uses a full-width heating device that heats a steel sheet over an entire area in a width direction of the steel sheet, an edge heating device that heats end portions in the width direction of the steel sheet, and a cold rolling mill that rolls the steel sheet and that is arranged on a downstream side in a rolling direction with respect to the full-width heating device and the edge heating device, the method includes: heating the steel sheet by using the full-width heating device and the edge heating device in such a manner that temperatures of the end portions in the width direction becomes higher than a temperature of a central portion in the width direction of the steel sheet on an entry side of the cold rolling mill.

8 Claims, 4 Drawing Sheets

(56) References Cited

U.S. PATENT DOCUMENTS

| | | | | |
|---|---|---|---|---|
| 5,927,118 | A * | 7/1999 | Minote | B21B 45/004 72/12.2 |
| 5,990,464 | A * | 11/1999 | Hino | B21B 1/26 219/602 |
| 8,943,868 | B2 | 2/2015 | Mimura et al. | |
| 9,523,135 | B2 | 12/2016 | Mimura et al. | |
| 10,207,303 | B2 | 2/2019 | Ueno et al. | |
| 10,259,027 | B2 | 4/2019 | Ueno et al. | |
| 10,710,133 | B2 | 7/2020 | Shimoda et al. | |
| 11,612,923 | B2 | 3/2023 | Fukushima | |
| 2010/0275667 | A1* | 11/2010 | Seidel | B21B 1/46 72/127 |
| 2016/0332203 | A1 | 11/2016 | Ueno et al. | |
| 2020/0230673 | A1 | 7/2020 | Fukushima | |

FOREIGN PATENT DOCUMENTS

| | | | |
|---|---|---|---|
| CN | 101945714 | A | 1/2011 |
| CN | 105934285 | A | 9/2016 |
| CN | 110300633 | A | 10/2019 |
| EP | 0 826 436 | A1 | 3/1998 |
| EP | 3 100 793 | A1 | 12/2016 |
| EP | 3 590 614 | A1 | 1/2020 |
| JP | 0523724 | A | 2/1993 |
| JP | H10-085802 | A | 4/1998 |
| JP | 2004-143528 | A | 5/2004 |
| JP | 2011079025 | A | 4/2011 |
| JP | 2011-240397 | A | 12/2011 |
| JP | 2012148310 | A | 8/2012 |
| JP | 2019-181500 | A | 10/2019 |
| JP | 2021030239 | A | 3/2021 |
| TW | 201545822 | A | 12/2015 |
| TW | 201838731 | A | 11/2018 |
| WO | 2004-000476 | A1 | 12/2003 |

OTHER PUBLICATIONS

JP 02-6009A, Ichii et al. Jan. 1990.*

Translation JP 02-6009A, Ichii et al. Jan. 1990.*

Translation JP 2021-030209A, Shiraishi et al. Mar. 2021.*

International Search Report and Written Opinion for International Application No. PCT/JP2021/046317, dated Mar. 1, 2022, 6 pages.

Taiwanese Search Report for Taiwanese Application No. 110148757, dated Aug. 17, 2022, with partial translation, 12 pages.

Extended European Search Report issued May 14, 2025, by the European Patent Office in corresponding European Patent Application No. 21939384.0-1103. (11 pages).

Office Action (The First Office Action) issued Jan. 14, 2026, by the State Intellectual Property Office of People's Republic of China in corresponding Chinese Patent Application No. 202180096457.5 and an English translation of the Office Action. (17 pages).

* cited by examiner

MANUFACTURING METHOD AND MANUFACTURING EQUIPMENT OF COLD-ROLLED STEEL SHEET

CROSS REFERENCE TO RELATED APPLICATIONS

This is the U.S. National Phase application of PCT/JP2021/046317, filed Dec. 15, 2021, which claims priority to Japanese Patent Application No. 2021-077586, filed Apr. 30, 2021, the disclosures of these applications being incorporated herein by reference in their entireties for all purposes.

FIELD OF THE INVENTION

The present invention relates to a manufacturing method and manufacturing equipment of a cold-rolled steel sheet.

BACKGROUND OF THE INVENTION

Conventionally, a single-stand reverse mill such as a Sendzimir mill, or a tandem mill having a plurality of stands is used in cold rolling. In any case, a steel sheet temperature on an entry side of a rolling mill in a first path is often a room temperature. Incidentally, in cold rolling of a silicon steel sheet (electrical steel sheet) having a high Si content, brittle fracture of the steel sheet is likely to be generated in a case where a steel sheet temperature is low. As a fracture form at this time, there are a case where the steel sheet is fractured from end portions in a width direction, a case where the steel sheet is fractured from a central portion in the width direction, and the like. In any case, as a measure against the fracture, it is effective to increase the steel sheet temperature during the cold rolling. From such a background, a method of controlling the fracture of the silicon steel sheet by heating the silicon steel sheet before the cold rolling has been proposed. For example, Patent Literature 1 discloses a method of heating end portions in a width direction of a steel sheet in such a manner that a target temperature designated on an entry side of a rolling mill is reached. Furthermore, Patent Literature 2 discloses a method of uniformly heating and rolling an entire area of a steel sheet.

PATENT LITERATURE

Patent Literature 1: Japanese Patent Application Laid-open No. 2012-148310

Patent Literature 2: Japanese Patent Application Laid-open No. 2011-79025

SUMMARY OF THE INVENTION

As described above, a technology of controlling generation of brittle fracture when a silicon steel sheet having a high Si content is cold-rolled has been proposed. However, in a technology of heating only end portions in a width direction of a steel sheet, there is a possibility that brittle fracture at a central portion in the width direction is generated since a steel sheet temperature near the central portion in the width direction is low. In addition, in a technology of uniformly heating an entire area in a width direction of a steel sheet, there is a possibility that the entire steel sheet is heated by application of more energy than necessary, and it is considered that there is room for reviewing from a viewpoint of SDGs (sustainable development goals).

Aspects of the present invention have been made in view of the above problems, and an object thereof is to provide a manufacturing method and manufacturing equipment of a cold-rolled steel sheet, which are capable of stably rolling a silicon steel sheet with a low environmental load.

In order to achieve the above object, the inventors of the present invention have intensively conducted studies, and found that a fracture control temperature (steel sheet temperature having a high fracture control effect) is higher at end portions in a width direction than at a central portion in the width direction. Thus, the inventors have conceived that it is very effective to combine a full-width heating device that heats an entire area in a width direction of a steel sheet and an edge heating device that heats end portions in the width direction of the steel sheet and to appropriately control and use output of the both in terms of fracture control and environment, and have arrived at the following invention.

A manufacturing method of a cold-rolled steel sheet according to aspects of the present invention is the method that uses a full-width heating device that heats a steel sheet over an entire area in a width direction of the steel sheet, an edge heating device that heats end portions in the width direction of the steel sheet, and a cold rolling mill that rolls the steel sheet and that is arranged on a downstream side in a rolling direction with respect to the full-width heating device and the edge heating device. The method includes: a step of heating the steel sheet by using the full-width heating device and the edge heating device in such a manner that temperatures of the end portions in the width direction becomes higher than a temperature of a central portion in the width direction of the steel sheet on an entry side of the cold rolling mill.

The temperatures of the central portion in the width direction and the end portions in the width direction of the steel sheet on the entry side of the cold rolling mill may change according to an Si content of the steel sheet.

The temperatures of the central portion in the width direction and the end portions in the width direction of the steel sheet on the entry side of the cold rolling mill may be calculated from following expressions (1) and (2), the temperatures calculated from the expressions (1) and (2) being configured to change depending on an Si content α.

$$T_C \geq 0.1\alpha^{4.5}+15 \quad (1)$$

$$T_E \geq 0.1\alpha^{4.8}+15 \quad (2)$$

$T_C$: Steel sheet temperature of a central portion in a width direction of a steel sheet on entry side of a rolling mill [° C.] $T_C \leq 200°$ C.

$T_E$: Steel sheet temperatures of end portions in a width direction of a steel sheet on entry side of a rolling mill [° C.] $T_E \leq 200°$ C.

α:Si content [%] $0<\alpha\leq 4.5$

A full-width heating step of heating the steel sheet over the entire area in the width direction of the steel sheet by the full-width heating device, an edge heating step of heating the end portions in the width direction of the steel sheet by the edge heating device, and a rolling step of rolling the steel sheet by the cold rolling mill may be performed in this order.

An edge heating step of heating the end portions in the width direction of the steel sheet by the edge heating device, a full-width heating step of heating the steel sheet over the entire area in the width direction of the steel sheet by the full-width heating device, and a rolling step of rolling the steel sheet by the cold rolling mill may be performed in this order.

Manufacturing equipment of a cold-rolled steel sheet according to aspects of the present invention, includes: a full-width heating device that heats a steel sheet over an entire area in a width direction of the steel sheet; an edge heating device that heats end portions in the width direction of the steel sheet; and a cold rolling mill that rolls the steel sheet and that is arranged on a downstream side in a rolling direction with respect to the full-width heating device and the edge heating device, wherein the full-width heating device and the edge heating device heat the steel sheet in such a manner that temperatures of the end portions in the width direction becomes higher than a temperature of a central portion in the width direction of the steel sheet on an entry side of the cold rolling mill.

The full-width heating device and the edge heating device may change the temperatures of the central portion in the width direction and the end portions in the width direction of the steel sheet on the entry side of the cold rolling mill according to an Si content of the steel sheet.

The full-width heating device and the edge heating device may heat the temperatures of the central portion in the width direction and the end portions in the width direction of the steel sheet on the entry side of the cold rolling mill to temperatures that are calculated from following expressions (1) and (2), the temperatures calculated from the expressions (1) and (2) being configured to change depending on an Si content $\alpha$.

$$T_C \geq 0.1\alpha^{4.5}+15 \quad (1)$$

$$T_E \geq 0.1\alpha^{4.8}+15 \quad (2)$$

$T_C$: Steel sheet temperature of a central portion in a width direction of a steel sheet on entry side of a rolling mill [° C.] $T_C \leq 200°$ C.

$T_E$: Steel sheet temperatures of end portions in a width direction of a steel sheet on entry side of a rolling mill [° C.] $T_E \leq 200°$ C.

$\alpha$: Si content [%] $0<\alpha\leq 4.5$

The full-width heating device and the edge heating device may be installed at positions within 10 m from the entry side of the cold rolling mill.

The full-width heating device may be a solenoid-type induction heating device.

The full-width heating device and the edge heating device may be arranged in this order from an upstream side in the rolling direction of the cold rolling mill.

The edge heating device and the full-width heating device may be arranged in this order from an upstream side in the rolling direction of the cold rolling mill.

According to a manufacturing method and manufacturing equipment of a cold-rolled steel sheet according to aspects of the present invention, it is possible to stably roll a silicon steel sheet with a low environmental load.

DETAILED DESCRIPTION OF EMBODIMENTS OF THE INVENTION

Hereinafter, a manufacturing method and manufacturing equipment of a cold-rolled steel sheet according to one embodiment of the present invention will be described with reference to the drawings. Note that components in the embodiment described in the following include those that can be easily replaced by those skilled in the art, or those that are substantially the same.

[Configuration]

First, a configuration of a manufacturing equipment of a cold-rolled steel sheet according to one embodiment of the present invention will be described with reference to FIG. 1.

Figure 1:
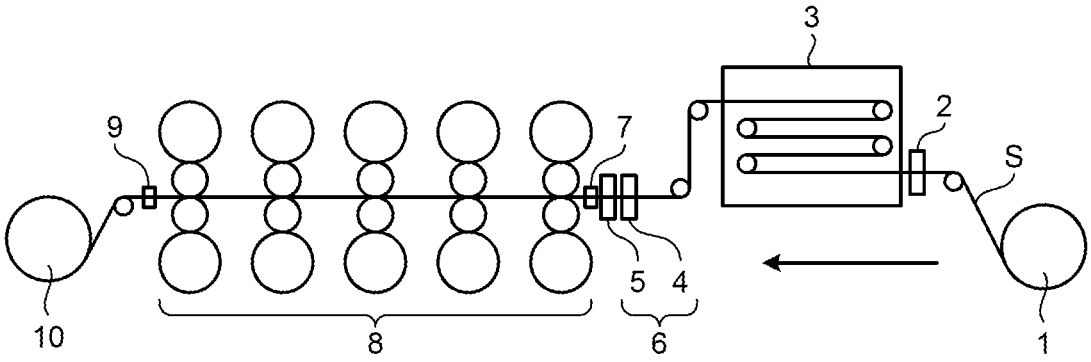
FIG. 1 is a schematic diagram illustrating a configuration of manufacturing equipment of a cold-rolled steel sheet according to one embodiment of the present invention.

FIG. 1 is a schematic diagram illustrating the configuration of the manufacturing equipment of a cold-rolled steel sheet according to the one embodiment of the present invention. As illustrated in FIG. 1, the manufacturing equipment of a cold-rolled steel sheet which equipment is the one embodiment of the present invention (hereinafter, abbreviated as "manufacturing equipment") is a continuous tandem rolling line having a plurality of stands, and includes a pay-off reel 1, a joining device 2, a looper 3, a full-width heating device 4, an edge heating device 5 (hereinafter, referred to as a "heating device 6" in a case where both of the full-width heating device 4 and the edge heating device 5 are referred to), a thermometer (sheet temperature measuring device) 7, a tandem cold rolling mill 8, a cutting machine (cutting device) 9, and a tension reel 10.

The pay-off reel 1 is a device that pays out a steel sheet S. The manufacturing equipment may include a plurality of the pay-off reels 1. In this case, the plurality of pay-off reels respectively pays off the different steel sheets S.

The joining device 2 is a device that joins a tail end of a steel sheet paid out from the pay-off reel 1 first (preceding material) and a leading end of a steel sheet subsequently paid out from the pay-off reel 1 (following material) and forms a joined steel sheet. As the joining device 2, a laser welding machine is suitably used.

The looper 3 is a device that stores the steel sheet S in such a manner that cold rolling by the tandem cold rolling mill 8 can be continued until the steel sheets are joined by the joining device 2 (until the joining is completed).

The full-width heating device 4 is a device that heats the steel sheet S over an entire area in a width direction and a rolling direction (longitudinal direction) of the steel sheet S. Note that the full-width heating device 4 preferably heats the steel sheet S in such a manner that a temperature at a central portion in the width direction of the steel sheet S on an entry side of the tandem cold rolling mill 8 becomes a temperature T c that corresponds to an Si content of the steel sheet S and that is calculated from the following expression (1). As a result, brittle fracture of the steel sheet S can be effectively controlled.

The edge heating device 5 is a device that heats edge portions (end portions in the width direction) of the steel sheet S over the entire area in the rolling direction. Note that the edge heating device 5 preferably heats the edge portions in such a manner that temperatures of the edge portions on the entry side of the tandem cold rolling mill 8 becomes a temperature T E that corresponds to the Si content of the steel sheet S and that is calculated from the following expression (2). At this time, it is also necessary to consider the temperatures of the edge portions which temperature rises by heating of the steel sheet S by the full-width heating device 4. As a result, an edge crack of the steel sheet S can be effectively controlled.

$$T_C \geq 0.1\alpha^{4.5}+15 \quad (1)$$

$$T_E \geq 0.1\alpha^{4.8}+15 \quad (2)$$

$T_C$: Steel sheet temperature of a central portion in a width direction of a steel sheet on entry side of a rolling mill [° C.] $T_C \leq 200°$ C.

$T_E$: Steel sheet temperatures of end portions in a width direction of a steel sheet on entry side of a rolling mill [° C.] $T_E \leq 200°$ C.

$\alpha$: Si content [%] $0<\alpha\leq 4.5$

The thermometer 7 is a device that measures a surface temperature of the steel sheet S. The thermometer 7 is preferably installed immediately near the entry side of the tandem cold rolling mill 8. However, in practice, the steel sheet temperature measured by the thermometer 7 is not used as it is. Instead, a value acquired by compensation of the steel sheet temperature that decreases from the thermometer 7 to the entry side of the tandem cold rolling mill 8 is used for practical use.

The tandem cold rolling mill 8 is a device that cold-rolls the steel sheet S in order to set a sheet thickness of the steel sheet S heated by the full-width heating device 4 and the edge heating device 5 to a target sheet thickness. In the present embodiment, the tandem cold rolling mill 8 includes five stands. However, the number of stands is not specifically limited. Furthermore, in the present embodiment, the tandem cold rolling mill 8 has a form called 4Hi having four rolls in one stand. However, this is not a limitation, and other forms such as 6Hi can also be applied.

The cutting machine 9 is a device that cuts the steel sheet S after the cold rolling.

The tension reel 10 is a device that winds up the steel sheet S cut by the cutting machine 9. A form of the tension reel 10 is not limited, and may be, for example, a carousel tension reel. Furthermore, the manufacturing equipment may include a plurality of the tension reels 10. In this case, the plurality of tension reels 10 continuously winds up the plurality of steel sheets S.

Devices included in the manufacturing equipment are not limited to the above-described devices. In the manufacturing equipment, the heating device 6 (order of the full-width heating device 4 and the edge heating device 5 is not limited) and the entry side of the tandem cold rolling mill 8 only need to be arranged in this order within 10 m (more preferably, arranged adjacent to each other). Thus, the rolling mill may be a reverse rolling mill instead of a tandem rolling mill. In this case, the heating device 6 and the rolling mill are arranged in this order in the first path. In addition, a cold rolling step and a pickling step, which is a preceding step of the cold rolling step, can be made continuous, and a pickling device that pickles the steel sheet S may be arranged between the looper 3 and the tandem cold rolling mill 8.

[Heating Step]

Next, a heating step of the steel sheet S by the heating device 6 which step is a feature of the manufacturing method of the cold-rolled steel sheet, the manufacturing method being the one embodiment of the present invention, will be described. Note that although a specific heating means of the heating device 6 is not specifically limited, a case where the heating device 6 is an induction heating device will be described as an example in the following. The full-width heating device 4 may be a solenoid-type or a transverse-type induction heating device. Furthermore, although the heating device 6 heats at least one of an upper surface or a lower surface of the steel sheet S, it is more preferable to heat both the upper surface and the lower surface.

In the heating step of the steel sheet S of the present embodiment, the heating device 6 determines a target temperature of the heating device 6 on the basis of a temperature of the steel sheet S which temperature is measured by the thermometer 7, a target temperature of the steel sheet S on an delivery side of each of the full-width heating device 4 and the edge heating device 5, time during which the steel sheet S passes through the heating device 6 (that is, heating time), and the sheet thickness of the steel sheet S. Note that the target temperature of the steel sheet S heated by the heating device 6 needs to be set to a temperature in which a distance between the thermometer 7 and the heating device 6 and a distance between the thermometer 7 and the tandem cold rolling mill 8 are considered. For example, in a case where the distance from the heating device 6 to the tandem cold rolling mill 8 is very short, there is no big problem even when the target temperature of the steel sheet S on the delivery side of the heating device 6 is set as the target temperature of the steel sheet S heated by the heating device 6. On the other hand, in a case where any one of the heating device 6, the thermometer 7, or the tandem cold rolling mill 8 is distant, it is necessary to set the target temperature of the steel sheet S heated by the heating device 6 in consideration of a temperature drop until the steel sheet S reaches the entry side of the tandem cold rolling mill 8. However, from a viewpoint of an environmental load, an amount of energy used for heating of the steel sheet is preferably small, and the heating device 6 and the thermometer 7 are preferably as close as possible to the tandem cold rolling mill 8.

Here, the inventors of the present invention investigated a fracture rate of when a silicon steel sheet was cold-rolled by a tandem rolling mill having five stands. As a result, it was found that a silicon steel sheet having a high Si content has the higher fracture rate than a silicon steel sheet having a low Si content. In addition, as a result of an investigation of a cause of the fracture, it was found that causes of fracture are different between fracture on an upstream side such as #1std (hereinafter, an N-th stand from the upstream side in a conveyance direction of the steel sheet is referred to as "#Nstd") or #2std and fracture on a downstream side such as #4std or #5std. That is, it was estimated that the fracture on the upstream side, specifically, the fracture directly under #1std or on the delivery side was caused by local squeezing of a shape of the steel sheet, such as body elongation or edge elongation, or bending deformation in a sheet passing roll or a shape meter. A draft of #1std is generally the highest among all stands, and it is considered that the cause of the fracture is likely to be generated due to a rapid shape change of the steel sheet. In addition, as a result of further investigation on the fracture on the upstream side, it was estimated that the fracture rate (fracture generation rate) varied depending on a season, and that the fracture rate was higher in winter than in summer and an outside air temperature (temperature in a rolling factory) affected the fracture rate, for example. On the other hand, with respect to the fracture on the downstream side, it was confirmed that an edge crack made in a stand on the upstream side progressed and led to the fracture. For this reason, it was considered that the both kinds of fracture could be controlled by an increase of the steel sheet temperature on an entry side of #1std although the places and the causes of the fracture generation were different.

In order to verify the above presumption, first, the bending crack resistance of a case where bending strain was applied to the steel sheet was evaluated on a laboratory scale. This is because the bending crack resistance in the present experiment is considered to be correlated with brittle fracture due to bending deformation in the sheet passing roll and the shape meter in the upstream stand described above. As sample materials, four kinds of silicon steel sheets each of which had a sheet thickness of 2 mm and which respectively had the Si content of 1.8 mass %, 2.8 mass %, 3.3 mass %, and 3.7 mass % (hereinafter, a silicon steel sheet having an Si content of M mass % is referred to as "M % Si steel") were annealed at 800° C. (corresponding to hot-rolled sheet annealing). Then, the annealed silicon steel sheets were pickled, and sample materials having a width of 24 mm and a length of 250 mm were cut out by utilization of a shearing machine. Then, both end faces were ground by 2 mm and processing distortion generated in shearing was removed. As a result, generation of edge fracture was controlled. Note that in an actual continuous cold rolling line, 1.8% Si steel and 2.8% Si steel are steel types in which brittle fracture is hardly generated. On the other hand, 3.3% Si steel and 3.7% Si steel are steel types in which brittle fracture is generated at a frequency of about a several % specifically in the upstream stand. Usually, in the cold rolling, the steel sheet temperature on the entry side of the rolling mill is about the same as the temperature in the factory, and it is about 15° C. in winter.

Figure 2:
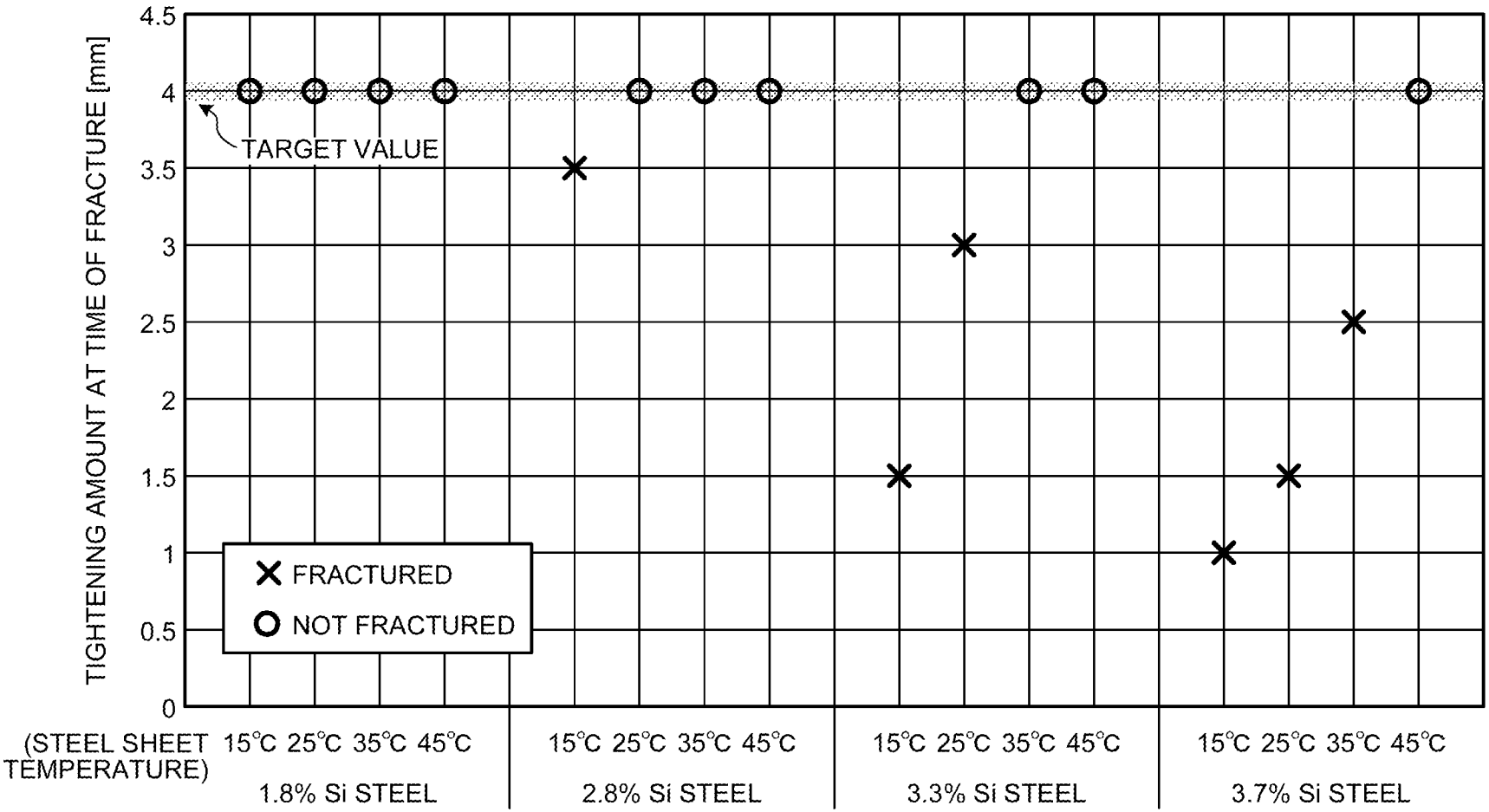
FIG. 2 is a view illustrating a result of evaluation of temperature dependency of bending crack resistance of a silicon steel sheet.

Thus, temperature dependency of the bending crack resistance of the silicon steel sheet of when the steel sheet temperature was within a range of 15° C. to 45° C. was investigated. In the present experiment, first, a steel sheet having a thickness of 2 mm was rolled at a draft of 50% and a steel sheet having a thickness of 1 mm was manufactured. This simulates #1std. Next, the steel sheet was made to pass through a roller leveler for simulation of bending deformation of the steel sheet in the sheet passing roll or the shape meter. Then, bending deformation was applied to the steel sheet and the bending cracking resistance was evaluated. The roller leveler has 11 upper and lower work rolls each of which has a diameter of 50 mm, and a roll interval is 60 mm. An arbitrary value can be given as a bending stress on a surface of the steel sheet by changing of a tightening amount of the upper work rolls. In the present experiment, the steel sheet temperature was changed in increments of 10° C., the roll tightening amount was changed in increments of 0.5 mm, and fracture limits of the steel sheet were sorted. It is considered that fracture is less likely to be generated even in the cold rolling line as the tightening amount at the time of fracture becomes larger. Results acquired in the present experiment are illustrated in FIG. 2. Note that in view of a fracture property in an actual continuous rolling mill, it was considered that the fracture was not generated even in the actual continuous rolling mill when the sheet could be made to pass through without being fractured up to the tightening amount of 4.0 mm under the present experimental conditions, and non-generation of the fracture at the tightening amount of 4.0 mm was set as a target value of the present experiment.

As illustrated in FIG. 2, when comparison was made for every Si content, 1.8% Si steel was not fractured until the tightening amount reached 4.0 mm regardless of the temperature of the steel sheet (15 to 45° C.). In addition, in 2.8% Si steel, the fracture was not generated up to the tightening amount of 4.0 mm at 25° C. or higher although the fracture was generated at the tightening amount of 3.5 mm when the steel sheet temperature was 15° C. In addition, in 3.3% Si steel, the fracture was generated at the tightening amount of 1.5 mm when the steel sheet temperature was 15° C., and the fracture was generated at the tightening amount of 3.0 mm when the steel sheet temperature was 25° C. However, when the steel sheet temperature was 35° C. or higher, the fracture was not generated until the tightening amount reached 4.0 mm. In addition, in 3.7% Si steel, the fracture was generated at the tightening amount of 1.0 mm when the steel sheet temperature was 15° C., was generated at 1.5 mm when the steel sheet temperature was 25° C., and was generated at 2.5 mm when the steel sheet temperature was 35° C. When the steel sheet temperature was set to 45° C., the fracture was not generated until the tightening amount reached 4.0 mm. As a result of the above experiment, it was confirmed that the Si content had a large influence on fracture resistance of the steel sheet, and the steel sheet was more likely to be fractured as the Si content was higher. This is also consistent with an actual fracture in the actual continuous cold rolling mill. Specifically in 3.3% Si steel and 3.7% Si steel, as a result of the experiment with the changes in the temperature of the steel sheet, the brittle fracture could be controlled as the temperature became higher.

Figure 3:
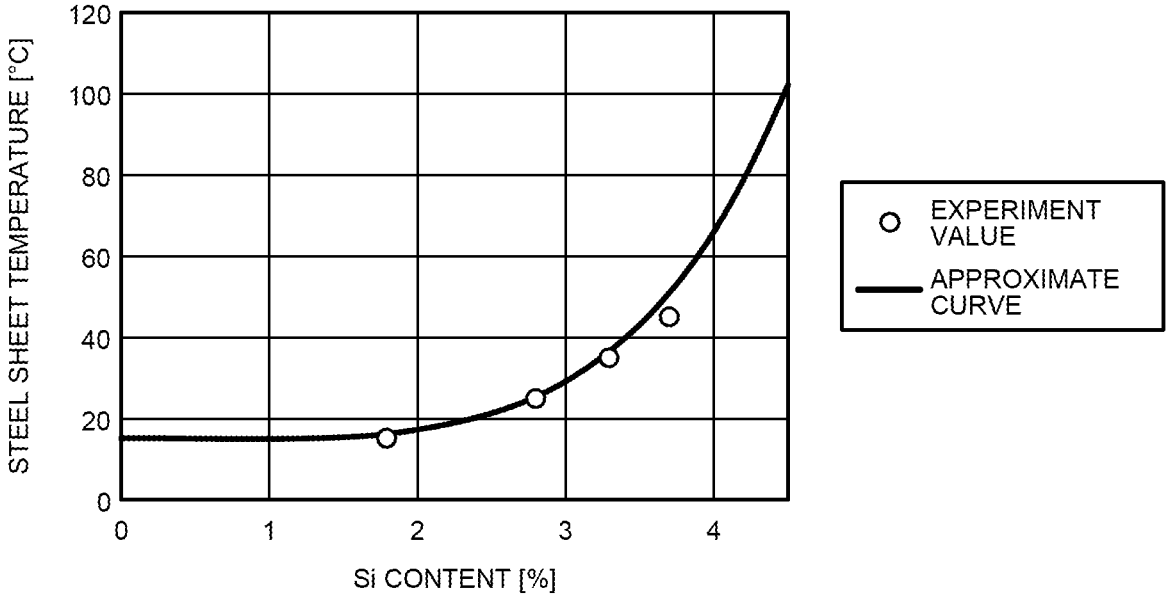
FIG. 3 is a view illustrating an estimation result of a steel sheet temperature necessary for controlling brittle fracture according to an Si content of the steel sheet.

A result of estimation of a steel sheet temperature necessary for brittle fracture control according to the Si content of the steel sheet based on the results of the present experiment is illustrated in FIG. 3. An approximate curve in the drawing can be expressed by the following expression (3). In the present experiment, for 1.8% Si steel, since the brittle fracture was not generated up to the tightening amount of 4.0 mm even at the steel sheet temperature of 15° C., it is considered that heating of the steel sheet by the heating device 6 is unnecessary. However, for 2.8% Si steel, since the fracture was generated at the tightening amount of 3.5 mm when the steel sheet temperature was 15° C., it is considered that the steel sheet needs to be heated by the heating device 6 at the time when the steel sheet temperature becomes low. Thus, a value of an Si content $\alpha$[%] in the expression (3) is considered to be about $\alpha>2$ in practice. Furthermore, a steel sheet temperature $T_{Cmin}$ calculated from the expression (3) is a minimum necessary temperature, and the steel sheet temperature only needs to be equal to or higher than this temperature from a viewpoint of the fracture control. However, when the steel sheet temperature becomes too high, a shape and lubricity of the steel sheet are affected. Thus, the steel sheet temperature is set to 200° C. or lower. Furthermore, an upper limit 4.5% of the Si content $\alpha$ was set within a range in which temperatures of a steel sheet edge portions described later became 200° C. or lower.

$$T_{Cmin}=0.1\alpha^{4.5}+15 \quad (3)$$

$T_{Cmin}$: Minimum necessary temperature of a central portion in a width direction of a steel sheet on entry side of a rolling mill [° C.]

$\alpha$: Si content [%] $0<\alpha\leq 4.5$

Next, in order to control fracture caused by a steel sheet edge crack, the steel sheet was rolled on a laboratory scale and it was evaluated whether the edge crack was generated. The present experiment was to work on a fracture form in which the edge crack generated on the upstream side in the rolling direction expanded and fractured as the edge crack advanced to a stand on the downstream side in the rolling direction, and it was considered that the fracture due to the steel sheet edge crack could be controlled when the edge crack at a stand on the upstream side could be completely controlled. As sample materials, four kinds of silicon steel sheets each of which had a sheet thickness of 2 mm and which were respectively 1.8% Si steel, 2.8% Si steel, 3.3%

Si steel, and 3.7% Si steel were cut into a width of 20 mm and a length of 250 mm, and annealed at 800° C. (corresponding to hot-rolled sheet annealing). Then, the annealed silicon steel sheets were picked. A state of the steel sheet edge portions at this time can be considered to be close to a state on an entry side of the actual continuous cold rolling mill.

Note that in the actual continuous cold rolling line, 1.8% Si steel is a steel type in which the steel sheet edge crack is less likely to be generated. On the other hand, 3.3% Si steel and 3.7% Si steel are steel types in which the steel sheet edge crack is generated at a frequency of about a several %. Usually, in the cold rolling, the steel sheet temperature on the entry side of the rolling mill is about the same as the temperature in the factory, and it is about 15° C. in winter. Thus, temperature dependency of the edge crack resistance of the silicon steel sheet of when the steel sheet temperature was within a range of 15° C. to 65° C. was investigated. In the present experiment, by simulation of #1std, the edge crack resistance was evaluated from the number of cracks (cracks of 1 mm or larger) generated on both end faces (longitudinal direction) of the steel sheet of when the sample materials of W20×L250 mm were rolled at a draft of 50%. Note that the number of times of rolling at each amount of Si and each temperature is five times, and the number of edge cracks is an average value of the five times. Furthermore, the steel sheet temperature was set at intervals of 10° C. Results acquired in the present experiment are illustrated in FIG. 4.

Figure 4:
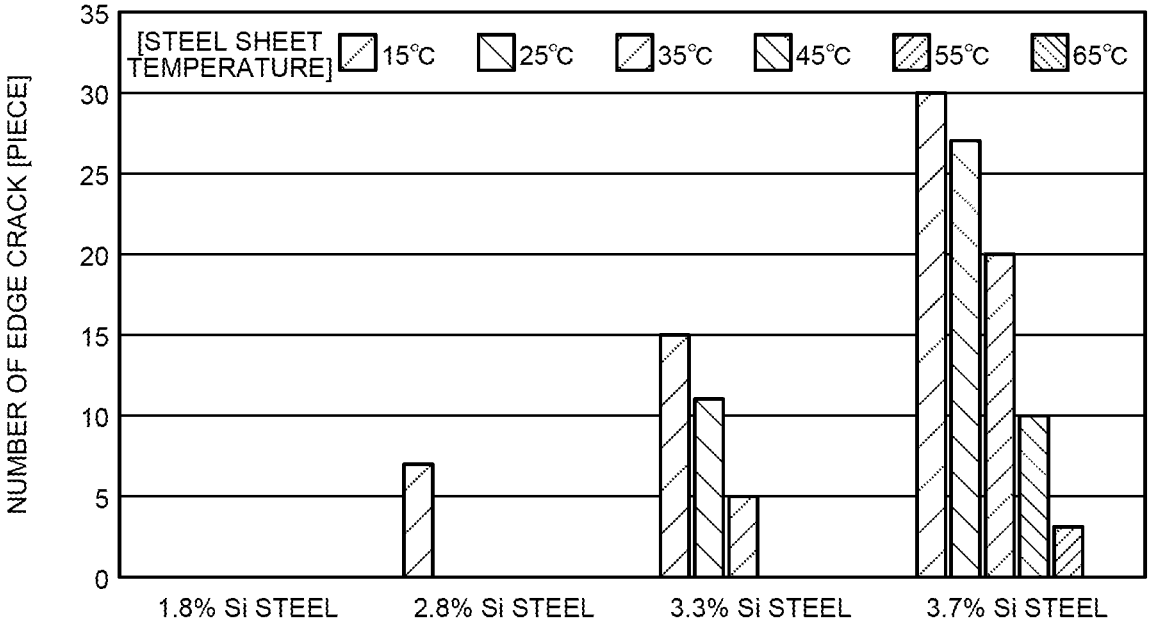
FIG. 4 is a view illustrating a result of evaluation of temperature dependency of edge crack resistance of the silicon steel sheet.

As illustrated in FIG. 4, in a case of the steel sheet temperature of 15° C., when comparison was made for every Si content, no edge crack was generated in the both end faces in 1.8% Si steel. In 2.8% Si steel, seven edge cracks were generated in total in the both end faces. 15 edge cracks were generated in total in the both end faces in 3.3% Si steel, and 30 edge cracks were generated in 3.7% Si steel. In a case where the steel sheet temperature was 25° C., even in a case of 2.8% Si steel in addition to 1.8% Si steel, the total number of edge cracks in the both end faces was 0. On the other hand, the number was 11 for 3.3% Si steel and was 27 for 3.7% Si steel. In a case where the steel sheet temperature was 35° C., the total number of edge cracks in the both end faces was 0 in 1.8% Si steel and 2.8% Si steel. On the other hand, five edge cracks were generated in total in the both end faces in 3.3% Si steel, and 20 edge cracks were generated in 3.7% Si steel. In a case where the steel sheet temperature was 45° C., the total number of edge cracks in the both end faces was 0 in 3.3% Si steel in addition to 1.8% Si steel and 2.8% Si steel. On the other hand, 10 edge cracks were generated in 3.7% Si steel. In a case where the steel sheet temperature was 55° C., the total number of edge cracks in the both end faces was 0 in 3.3% Si steel in addition to 1.8% Si steel and 2.8% Si steel. On the other hand, three edge cracks were generated in 3.7% Si steel. In a case where the steel sheet temperature was 65° C., the total number of edge cracks in the both end faces became 0 in 3.7% Si steel in addition to 1.8% Si steel, 2.8% Si steel, and 3.3% Si steel. From the results of the above experiment, it was confirmed that the Si content had a large influence on the edge crack resistance, and the steel sheet edge crack was more likely to be generated as the Si content became higher. This is also consistent with an actual state of the steel sheet edge crack in the actual continuous cold rolling mill.

Figure 5:
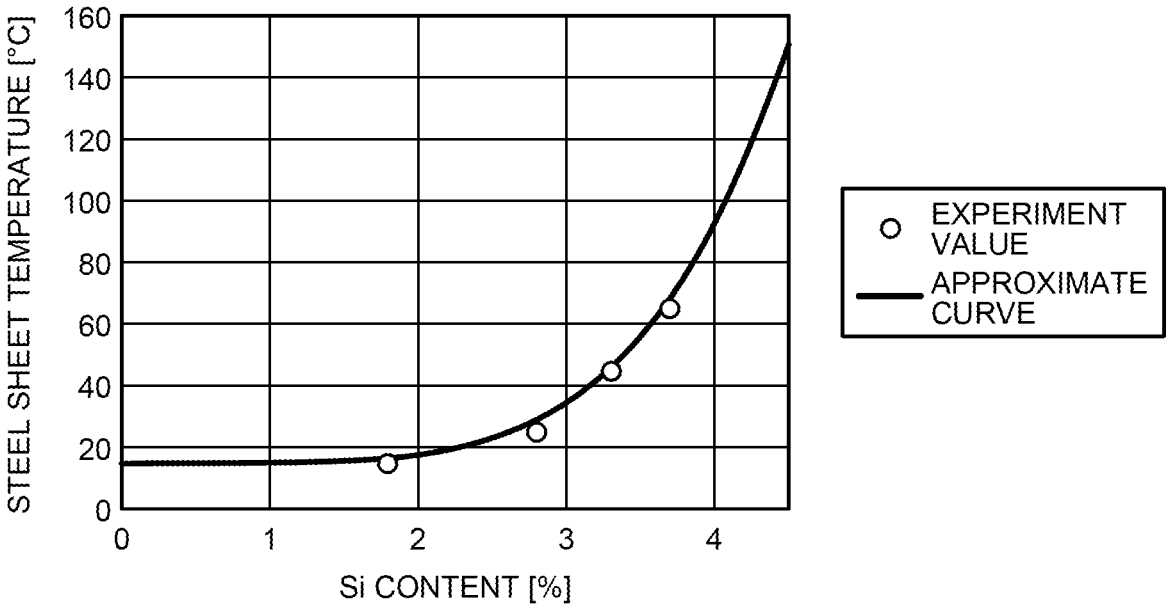
FIG. 5 is a view illustrating an estimation result of the steel sheet temperature necessary for controlling an edge crack according to the Si content of the steel sheet.

A result of estimation of a temperature necessary for steel sheet edge crack control according to the Si content of the steel sheet based on the results of the present experiment is illustrated in FIG. 5. An approximate curve in the drawing can be expressed by the following expression (4). In the present experiment, for 1.8% Si steel, since the steel sheet edge crack was not generated even at the steel sheet temperature of 15° C., it is considered that heating of the steel sheet by the heating device 6 is unnecessary. However, for 2.8% Si steel, since the steel sheet edge crack was generated when the steel sheet temperature was 15° C., it is considered that the steel sheet needs to be heated by the heating device 6 at the time when the steel sheet temperature becomes low. Thus, the Si content $\alpha$[%] in the expression (4) is considered to be about $\alpha>2$ in practice. Furthermore, a steel sheet temperature $T_{Emin}$ calculated from the expression (4) is a minimum necessary temperature, and the steel sheet temperature only needs to be equal to or higher than this temperature from a viewpoint of the fracture control. However, when the steel sheet temperature becomes too high, a shape and lubricity of the steel sheet are affected. Thus, the steel sheet temperature is set to 200° C. or lower. Furthermore, the upper limit 4.5% of the Si content $\alpha$ was set in a range in which the temperatures of the steel sheet edge portions which temperature was calculated from the expression (4) became 200° C. or lower. Note that a heating range of the steel sheet is set to a range of 30 mm or more from the edge portions of the steel sheet. This is because an influence on the steel sheet edge crack is in an influence range of width expansion in the cold rolling and the range is said to be about 30 mm from the edge portions of the steel sheet.

$$T_{Emin}=0.1\alpha^{4.8}+15 \quad (4)$$

$T_{Emin}$: Minimum necessary temperature of end portions in a width direction of a steel sheet on entry side of a rolling mill [° C.]

$\alpha$: Si content [%] $0<\alpha\leq 4.5$

From the two experiments described above, it can be understood that heating temperatures of the steel sheet which temperatures are necessary for control of the fracture from the central portion in the width direction of the steel sheet and the fracture from the edge portions are different. For example, in a case of 3.7% Si steel, the temperature necessary for the control of the fracture from the central portion in the width direction is 45° C. or higher, and the temperature necessary for the control of the edge crack is 65° C. or higher. As described above, in order to control the fracture of the silicon steel sheet, it has been found that, in addition to setting of a heating amount corresponding to the Si content, it is necessary to provide a temperature gradient in the width direction of the steel sheet in such a manner that the temperatures of the edge portions are higher than that of the central portion in the width direction even in the same steel type, and aspects of the present invention have been conceived. Note that in a case where a plurality of steel sheets having different Si contents are conveyed in the same equipment, the heating device 6 acquires information indicating Si contents of a preceding material and a following material, and changes and determines target temperatures on the basis of the information. Furthermore, although a material to be rolled has been described as a silicon steel sheet in the present embodiment, a type of a steel sheet is not limited. As steel sheets to which the technology of aspects of the present invention can be suitably applied, for example, there are a high-strength steel sheet and a high-alloy steel sheet other than the silicon steel sheet.

As described above, according to the manufacturing equipment and the manufacturing method of a cold-rolled steel strip which are the one embodiment of the present invention, the full-width heating device 4 and the edge heating device 5 are used in combination, whereby temperatures necessary for controlling the fracture from the central portion in the width direction and the edge crack are respectively and appropriately controlled and the fracture of the steel sheet is controlled. Thus, according to the manufacturing equipment of the cold-rolled steel strip and the manufacturing method of the cold-rolled steel strip which are the one embodiment of the present invention, when a silicon steel sheet is cold-rolled, fracture of the steel sheet can be controlled with minimum necessary energy. Thus, the silicon steel sheet can be stably cold-rolled with a minimum environmental load.

EXAMPLES

Examples indicating effects according to aspects of the present invention will be described. In the present example, a full-width heating device and an edge heating device are installed on an entry side of a cold rolling mill in order from an upstream side in a rolling direction, and a steel sheet temperature on the entry side of the rolling mill can be set to an arbitrary temperature. Then, a steel sheet was finished to a predetermined sheet thickness by a five-stand tandem cold rolling mill. Steel types used in the present example were all silicon steel sheets, and were divided into three groups according to Si contents. Specifically, the three groups are a group with an Si content of 1.0 mass % to 2.0 mass %, a group with an Si content of 2.0 mass % to 3.0 mass %, and a group with an Si content of 3.0 mass % to 3.5 mass %. In each group, a sheet thickness before rolling is 1.8 mm to 2.4 mm, and a sheet thickness after rolling is 0.3 mm to 0.5 mm. In order to investigate a fracture rate due to a difference in the Si contents, it was ensured that sheet thickness did not become uneven among the groups. A fracture rate of 200 coils in each group was investigated. Note that an outside air temperature (temperature in the factory) was about 15° C. The investigated coils and conditions are illustrated in Table 1. A steel sheet temperature was measured by utilization of a thermometer installed on the entry side of the rolling mill.

TABLE 1

| No. | Title | Heating device: Full width | Heating device: Edge | Si content [%] | Steel sheet temperature at entry side of rolling mill [° C.]: Width center | Steel sheet temperature at entry side of rolling mill [° C.]: Edge | Heating system (full width) | Rolling mill-heating device distance [m] | Fracture rate [%] | Note |
|---|---|---|---|---|---|---|---|---|---|---|
| 1 | Reference example | Not used | Not used | 1.0-2.0 | (15) | (15) | — | — | 0 | |
| | | | | 2.0-3.0 | (15) | (15) | | | 1 | |
| | | | | 3.0-3.5 | (15) | (15) | | | 3 | |
| 2 | First invention example | Used | Used | 1.0-2.0 | 17 | 18 | Solenoid | 10 m | 0 | Order of full width, edge, and heater |
| | | | | 2.0-3.0 | 30 | 35 | | | 0 | |
| | | | | 3.0-3.5 | 45 | 60 | | | 0 | |
| 3 | Second invention example | Used | Used | 1.0-2.0 | 17 | 18 | Solenoid | 10 m | 0 | Order of edge, full width, and heater |
| | | | | 2.0-3.0 | 30 | 35 | | | 0 | |
| | | | | 3.0-3.5 | 45 | 60 | | | 0 | |
| 4 | Third invention example | Used | Used | 1.0-2.0 | 17 | 18 | Solenoid | 1 to 1.5 m | 0 | |
| | | | | 2.0-3.0 | 30 | 35 | | | 0 | |
| | | | | 3.0-3.5 | 45 | 60 | | | 0 | |
| 5 | Fourth invention example | Used | Used | 1.0-2.0 | 17 | 18 | Transverse | 10 m | 0 | |
| | | | | 2.0-3.0 | 30 | 35 | | | 0 | |
| | | | | 3.0-3.5 | 45 | 60 | | | 0 | |
| 6 | First comparative example | Used | Not used | 1.0-2.0 | 17 | 16 | Solenoid | 10 m | 0 | Use expression (1) |
| | | | | 2.0-3.0 | 30 | 25 | | | 0.5 | |
| | | | | 3.0-3.5 | 45 | 35 | | | 2 | |
| 7 | Second comparative example | Used | Not used | 1.0-2.0 | 20 | 18 | Solenoid | 10 m | 0 | Use expression (2) |
| | | | | 2.0-3.0 | 40 | 35 | | | 0 | |
| | | | | 3.0-3.5 | 70 | 60 | | | 0 | |
| 8 | Third comparative example | Not used | Used | 1.0-2.0 | 15 | 18 | — | 10 m | 0 | Use expression (2) |
| | | | | 2.0-3.0 | 15 | 35 | | | 0.5 | |
| | | | | 3.0-3.5 | 15 | 60 | | | 2 | |
| 9 | Fourth comparative example | Used | Used | 1.0-2.0 | 15 | 15 | Solenoid | 20 m | 0 | |
| | | | | 2.0-3.0 | 25 | 30 | | | 0 | |
| | | | | 3.0-3.5 | 40 | 50 | | | 1 | |
| 10 | Fifth comparative example | Used | Used | 1.0-2.0 | 15 | 15 | Solenoid | 10 m | 0 | Low steel sheet temperature |
| | | | | 2.0-3.0 | 20 | 25 | | | 0 | |
| | | | | 3.0-3.5 | 30 | 40 | | | 1.5 | |

Reference Example

An example of a case where the steel sheet is not heated by the full-width heating device and the edge heating device, that is, a case where the steel sheet temperature on the entry side of the rolling mill is about 15° C. is illustrated. A fracture rate of 200 coils having an Si content of 1.0 mass % to 2.0 mass % was 0%. On the other hand, a fracture rate of 200 coils having an Si content of 2.0 mass % to 3.0 mass % was 1%, and a fracture rate of 200 coils having an Si content of 3.0 mass % to 3.5 mass % was 3%.

First Invention Example

An example of a case where the steel sheet temperature on the entry side of the tandem cold rolling mill which temperature corresponded to the Si content of the silicon steel sheet was calculated from the above expressions (1) and (2) and the steel sheet was heated by the full-width heating device and the edge heating device on the basis of the calculated temperature is illustrated. This is a case of a configuration in which the full-width heating device, the edge heating device, and the tandem cold rolling mill are arranged in this order. Furthermore, a distance between the tandem cold rolling mill and the heating device is 10 m. In the present invention example, the temperatures of the edge portions are higher than that of the width center portion of the steel sheet. The fracture rate of the 200 coils having the Si content of 1.0 mass % to 2.0 mass % (17° C. at the width center, and 18° C. in the edge portions) was 0%. Furthermore, the fracture rate of the 200 coils having the Si content of 2.0 mass % to 3.0 mass % (30° C. at the width center, and 35° C. in the edge portions) was also 0%, and the fracture rate of the 200 coils having the Si content of 3.0 mass % to 3.5 mass % (45° C. at the width center, and 60° C. in the edge portions) was also 0%. It was confirmed that the fracture of the steel sheet could be significantly reduced by heating of the silicon steel sheet on the basis according to aspects of the present invention.

Second Invention Example

An example of a case where the steel sheet temperature on the entry side of the tandem cold rolling mill which temperature corresponded to the Si content of the silicon steel sheet was calculated from the above expressions (1) and (2) and the steel sheet was heated by the full-width heating device and the edge heating device on the basis of the calculated temperature is illustrated. This is a case of a configuration in which the edge heating device, the full-width heating device, and the tandem cold rolling mill are arranged in this order. That is, this is an example in which only arrangement order of the full-width heating device and the edge heating device is different from that of the first invention example. The fracture rate of the 200 coils having the Si content of 1.0 mass % to 2.0 mass % (17° C. at the width center, and 18° C. in the edge portions) was 0%. Furthermore, the fracture rate of the 200 coils having the Si content of 2.0 mass % to 3.0 mass % (30° C. at the width center, and 35° C. in the edge portions) was also 0%, and the fracture rate of the 200 coils having the Si content of 3.0 mass % to 3.5 mass % (45° C. at the width center, and 60° C. in the edge portions) was also 0%. It was confirmed that the fracture of the steel sheet could be controlled regardless of the order of the full-width heating device and the edge heating device in a case where the steel sheet temperature calculated from the above expressions (1) and (2) could be secured on the entry side of the tandem cold rolling mill.

Third Invention Example

An example of a case where the steel sheet temperature on the entry side of the tandem cold rolling mill which temperature corresponded to the Si content of the silicon steel sheet was calculated from the above expressions (1) and (2) and the steel sheet was heated by the full-width heating device and the edge heating device on the basis of the calculated temperature is illustrated. This is a case where the heating device is installed in such a manner that a distance between the tandem cold rolling mill and the heating device becomes between 1 m and 1.5 m. That is, the distance between the tandem cold rolling mill and the heating device is shorter than that in the first invention example, and the other conditions are the same as those in the first invention example. The fracture rate of the 200 coils having the Si content of 1.0 mass % to 2.0 mass % (17° C. at the width center, and 18° C. in the edge portions) was 0%. Furthermore, the fracture rate of the 200 coils having the Si content of 2.0 mass % to 3.0 mass % (30° C. at the width center, and 35° C. in the edge portions) was also 0%, and the fracture rate of the 200 coils having the Si content of 3.0 mass % to 3.5 mass % (45° C. at the width center, and 60° C. in the edge portions) was also 0%. Focusing only on the fracture rate, the fracture can be controlled up to 3.5% Si steel, which is the same as the first invention example. However, from a viewpoint of energy consumption, the energy consumption is significantly reduced as compared with the first invention example, and superiority of the third invention example can be confirmed. Thus, from a viewpoint of reducing the energy consumption (environmental resistance), it was confirmed that it was better that the distance between the tandem cold rolling mill and the heating device was shorter.

Fourth Invention Example

An example of a case where the steel sheet temperature on the entry side of the tandem cold rolling mill which temperature corresponded to the Si content of the silicon steel sheet was calculated from the above expressions (1) and (2) and the steel sheet was heated by the full-width heating device and the edge heating device on the basis of the calculated temperature is illustrated. Here, a transverse-type induction heating device is used. That is, the example was performed while the full-width heating device was changed from the solenoid-type induction heating device to the transverse-type induction heating device in the conditions of the first invention example. The fracture rate of the 200 coils having the Si content of 1.0 mass % to 2.0 mass % (17° C. at the width center, and 18° C. in the edge portions) was 0%. Furthermore, the fracture rate of the 200 coils having the Si content of 2.0 mass % to 3.0 mass % (30° C. at the width center, and 35° C. in the edge portions) was also 0%, and the fracture rate of the 200 coils having the Si content of 3.0 mass % to 3.5 mass % (45° C. at the width center, and 60° C. in the edge portions) was also 0%. It was confirmed that equivalent fracture control effects can be acquired in the solenoid-type and the transverse-type full-width heating devices.

First Comparative Example

An example of a case where the edge heating device was not used and only the full-width heating device was used is illustrated. A temperature of the steel sheet heated by the full-width heating device was calculated from the expression (1). That is, a temperature considered to be necessary for controlling an edge crack cannot be secured, and a steel sheet temperatures of edge portions is likely to decrease as compared with that of a width center portion. Thus, the edge temperature is lower than that of the width center portion. The fracture rate of the 200 coils having the Si content of 1.0 mass % to 2.0 mass % (17° C. at the width center, and 16° C. in the edge portions) was 0%. On the other hand, the fracture rate of the 200 coils having the Si content of 2.0 mass % to 3.0 mass % (30° C. at the width center, and 25° C. in the edge portions) was 0.5%, and the fracture rate of the 200 coils having the Si content of 3.0 mass % to 3.5 mass % (45° C. at the width center, and 35° C. in the edge portions) was 2%. As a result of investigation of a fracture form of the fractured coil, the fracture due to the edge crack could not be controlled although the fracture from the central portion in the width direction could be controlled.

Second Comparative Example

An example of a case where the edge heating device was not used and only the full-width heating device was used is illustrated. The temperature of the steel sheet heated by the full-width heating device was calculated from the expression (2). That is, the entire area in the width direction is heated in such a manner that the temperature of the edge portions becomes the temperature considered to be necessary for the edge crack control. The fracture rate of the 200 coils having the Si content of 1.0 mass % to 2.0 mass % (20° C. at the width center, and 18° C. in the edge portions) was 0%. Furthermore, the fracture rate of the 200 coils having the Si content of 2.0 mass % to 3.0 mass % (40° C. at the width center, and 35° C. in the edge portions) was 0%, and the fracture rate of the 200 coils having the Si content of 3.0 mass % to 3.5 mass % (70° C. at the width center, and 60° C. in the edge portions) was also 0%. However, the temperature of the central portion in the width direction is heated more than necessary from a viewpoint of the fracture control, and it is preferable to reduce an amount of input energy when an environmental load is considered.

Third Comparative Example

An example of a case where the full-width heating device was not used and only the edge heating device was used is illustrated. The temperatures of the steel sheet edge portions heated by the edge heating device was calculated from the expression (2). The fracture rate of the 200 coils having the Si content of 1.0 mass % to 2.0 mass % (15° C. at the width center, and 18° C. in the edge portions) was 0%. On the other hand, the fracture rate of the 200 coils having the Si content of 2.0 mass % to 3.0 mass % (15° C. at the width center, and 35° C. in the edge portions) was 0.5%, and the fracture rate of the 200 coils having the Si content of 3.0 mass % to 3.5 mass % (15° C. at the width center, and 60° C. in the edge portions) was 2%. As a result of investigation of a fracture form of the fractured coil, the fracture from the central portion in the width direction could not be controlled although the fracture due to the edge crack could be controlled.

Fourth Comparative Example

An example of a case where the steel sheet temperature on the entry side of the tandem cold rolling mill which temperature corresponded to the Si content of the silicon steel sheet was calculated from the above expressions (1) and (2) and the steel sheet was heated by the full-width heating device and the edge heating device on the basis of the calculated temperature is illustrated. This is a case where the distance between the heating device and the tandem cold rolling mill is 20 m. That is, in the conditions of the first invention example, the distance between the heating device and the tandem cold rolling mill was increased in this example. Since the distance between the heating device and the tandem cold rolling mill was long, even when the heating device was used up to an upper limit in capacity, the steel sheet temperature on the entry side of the tandem cold rolling mill which temperature was calculated from the above expressions (1) and (2) could not be achieved. The fracture rate of the 200 coils having the Si content of 1.0 mass % to 2.0 mass % (15° C. at the width center, and 15° C. in the edge portions) was 0%, and the fracture rate of the 200 coils having the Si content of 2.0 mass % to 3.0 mass % (25° C. at the width center, and 30° C. in the edge portions) was also 0%. On the other hand, the fracture rate of the 200 coils of 3.0 mass % to 3.5 mass % (40° C. at the width center, and 50° C. in the edge portions) was 1%. It was confirmed that the distance between the heating device and the tandem cold rolling mill was preferably short, and that the high Si steel was more likely to be fractured in a case where installation was at a distance at which the steel sheet temperature calculated from the above expressions (1) and (2) could not be secured even when the heating device was used up to the upper limit in capacity.

Fifth Comparative Example

An example of a case where the steel sheet was heated by the full-width heating device and the edge heating device in such a manner as to have a temperature about 30% lower than the steel sheet temperature on the entry side of the rolling mill which steel sheet temperature corresponded to the Si content of the silicon steel sheet and was calculated from the above expressions (1) and (2) is illustrated. Other conditions are the same as those in the first invention example. The fracture rate of the 200 coils having the Si content of 1.0 mass % to 2.0 mass % (15° C. at the width center, and 15° C. in the edge portions) was 0%, and the fracture rate of the 200 coils having the Si content of 2.0 mass % to 3.0 mass % (20° C. at the width center, and 25° C. in the edge portions) was also 0%. On the other hand, the fracture rate of the 200 coils having the Si content of 3.0 mass % to 3.5 mass % (30° C. at the width center, and 40° C. in the edge portions) was 1.5%. It was confirmed that the high Si steel was more likely to be fractured in a case where the temperature was lower than the steel sheet temperature calculated from the above expressions (1) and (2).

As illustrated above, it was confirmed that the fracture of the steel sheet could be controlled by application of aspects of the present invention and heating of the steel sheet on the entry side of the tandem cold rolling mill. Specifically, in a case of a silicon steel sheet having an Si content of 3 mass % or more, the fracture of the steel sheet can be significantly reduced by heating of the steel sheet to an appropriate temperature, whereby improvement in productivity and improvement in a yield can be achieved.

In the above, the manufacturing equipment of the cold-rolled steel strip and the manufacturing method of the cold-rolled steel strip according to aspects of the present invention have been specifically described with reference to the embodiment and examples for carrying out aspects of the invention. However, aspects of the present invention are not limited to these descriptions and should be broadly interpreted on the basis of the claims. It goes without saying that various changes, modifications, and the like based on these descriptions are also included in accordance with aspects of the present invention.

INDUSTRIAL APPLICABILITY

According to aspects of the present invention, it is possible to provide a manufacturing method and a manufacturing equipment of a cold-rolled steel sheet capable of stably rolling a silicon steel sheet with low environmental load.

REFERENCE SIGNS LIST

1 PAY-OFF REEL
2 JOINING DEVICE
3 LOOPER
4 FULL-WIDTH HEATING DEVICE
5 EDGE HEATING DEVICE
6 HEATING DEVICE
7 THERMOMETER
8 TANDEM COLD ROLLING MILL

9 CUTTING MACHINE
10 TENSION REEL
S STEEL SHEET

The invention claimed is:

1. A manufacturing method of a cold-rolled steel sheet in which the method uses a full-width heating device that heats a steel sheet over an entire area in a width direction of the steel sheet, an edge heating device that heats end portions in the width direction of the steel sheet, and a cold rolling mill that rolls the steel sheet and that is arranged on a downstream side in a rolling direction with respect to the full-width heating device and the edge heating device, the method comprising:

heating the steel sheet by using the full-width heating device and the edge heating device in such a manner that temperatures of the end portions in the width direction becomes higher than a temperature of a central portion in the width direction of the steel sheet on an entry side of the cold rolling mill, wherein the temperatures of the central portion in the width direction and the end portions in the width direction of the steel sheet on the entry side of the cold rolling mill are calculated from following expressions (1) and (2), the temperatures calculated from the expressions (1) and (2) being configured to change depending on an Si content α:

$$T_C \geq 0.1\alpha^{4.5}+15 \quad (1)$$

$$T_E \geq 0.1\alpha^{4.8}+15 \quad (2)$$

$T_C$: Steel sheet temperature of a central portion in a width direction of a steel sheet on entry side of a rolling mill [° C.] $T_C \leq 200°$ C.

$T_E$: Steel sheet temperatures of end portions in a width direction of a steel sheet on entry side of a rolling mill [° C.] $T_E \leq 200°$ C.

α:Si content [%] $0<\alpha\leq 4.5$.

2. The manufacturing method of the cold-rolled steel sheet according to claim 1, wherein heating the steel sheet over the entire area in the width direction of the steel sheet by the full-width heating device, heating the end portions in the width direction of the steel sheet by the edge heating device, and rolling the steel sheet by the cold rolling mill are performed in this order.

3. The manufacturing method of the cold-rolled steel sheet according to claim 1, wherein heating the end portions in the width direction of the steel sheet by the edge heating device, heating the steel sheet over the entire area in the width direction of the steel sheet by the full-width heating device, and rolling the steel sheet by the cold rolling mill are performed in this order.

4. Manufacturing equipment of a cold-rolled steel sheet, the equipment comprising:

a full-width heating device that heats a steel sheet over an entire area in a width direction of the steel sheet;

an edge heating device that heats end portions in the width direction of the steel sheet; and a cold rolling mill that rolls the steel sheet and that is arranged on a downstream side in a rolling direction with respect to the full-width heating device and the edge heating device, wherein the full-width heating device and the edge heating device heat the steel sheet in such a manner that temperatures of the end portions in the width direction becomes higher than a temperature of a central portion in the width direction of the steel sheet on an entry side of the cold rolling mill, wherein the full-width heating device and the edge heating device heat the temperatures of the central portion in the width direction and the end portions in the width direction of the steel sheet on the entry side of the cold rolling mill to temperatures that are calculated from following expressions (1) and (2), the temperatures calculated from the expressions (1) and (2) being configured to change depending on an Si content α:

$$T_C \geq 0.1\alpha^{4.5}+15 \quad (1)$$

$$T_E \geq 0.1\alpha^{4.8}+15 \quad (2)$$

$T_C$: Steel sheet temperature of a central portion in a width direction of a steel sheet on entry side of a rolling mill [° C.] $T_C \leq 200°$ C.

$T_E$: Steel sheet temperatures of end portions in a width direction of a steel sheet on entry side of a rolling mill [° C.] $T_E \leq 200°$ C.

α:Si content [%] $0<\alpha\leq 4.5$.

5. The manufacturing equipment of the cold-rolled steel sheet according to claim 4, wherein the full-width heating device and the edge heating device are installed at positions within 10 m from the entry side of the cold rolling mill.

6. The manufacturing equipment of the cold-rolled steel sheet according to claim 4, wherein the full-width heating device is a solenoid-type induction heating device.

7. The manufacturing equipment of the cold-rolled steel sheet according to claim 4, wherein the full-width heating device and the edge heating device are arranged in this order from an upstream side in the rolling direction of the cold rolling mill.

8. The manufacturing equipment of the cold-rolled steel sheet according to claim 4, wherein the edge heating device and the full-width heating device are arranged in this order from an upstream side in the rolling direction of the cold rolling mill.

* * * * *